US005456090A

United States Patent [19]

McCoy

[11] Patent Number: 5,456,090

[45] Date of Patent: Oct. 10, 1995

[54] BABY BOTTLE ICE

[76] Inventor: Mark McCoy, 941 SW. 69th Ave., Plantation, Fla. 33317

[21] Appl. No.: 277,996

[22] Filed: Jul. 20, 1994

[51] Int. Cl.[6] ..... F25D 3/08

[52] U.S. Cl. ..... 62/372; 62/457.3; 165/80.5; 215/11.1

[58] Field of Search ..... 62/371, 372, 457.1, 62/457.2, 457.3, 457.4, 529, 530; 215/11.6, 11.1, 12.2, 11.2; 165/80.5

[56] References Cited

U.S. PATENT DOCUMENTS

| | | | |
|---|---|---|---|
| 1,860,302 | 5/1932 | Thomas | 165/80.5 |
| 3,840,153 | 10/1974 | Devlin | 222/146 C |
| 4,597,435 | 7/1986 | Fosco | 62/457.4 |
| 4,886,176 | 12/1989 | Steakley | 215/229 |
| 5,009,083 | 4/1991 | Spinos et al. | 62/400 |
| 5,129,238 | 7/1992 | Schwartz et al. | 62/457.3 |

*Primary Examiner*—John M. Sollecito
*Attorney, Agent, or Firm*—Oltman and Flynn

[57] ABSTRACT

An insertion container is disclosed for use with a traditional type baby bottle with detachable cap and nipple. A preferred embodiment of the container includes a longitudinal tube filled an preferably presealed with a chilled nontoxic liquid such as frozen ice water. The tube is then inserted into a baby bottle and is supported within the bottle by a base rim which is located in the area between the top of the mouth of the bottle and the bottle cap. The base rim can include through holes for allowing baby bottle formula such as milk and the like to flow to the nipple portion of the bottle. Optionally, the base rim can include a rubber type plug to seal the holes and prevent the formula in the bottle from spilling outside the bottle. The elongated insert tube can be sized longer for large bottles and alternatively curve shaped for use with bottles that have a center through hole for gripping the bottle.

12 Claims, 4 Drawing Sheets

BABY BOTTLE ICE

This invention relates to baby bottles, and in particular to an apparatus container for keeping liquid formula cold in baby bottles.

BACKGROUND AND PRIOR ART

Liquid baby formulas such as but not limited to milk mixtures and the like are generally required to be kept cold when stored in order to preserve the nutrients for health and safety reasons. Normal means of keeping the formulas cold is by storage in refrigerators. However, refrigerators are not a possible option when families are travelling either by foot or automobile. Furthermore, it is not practical to leave ice cubes in the formula since the cubes melt and thus wig dilute the formula itself. Portable ice chests are also not practical since they are often large and difficult to carry while travelling on foot through such places as shopping malls, stores and public places.

Thus, the need exists for a suitable container that can keep baby bottle formula cold to prevent spoiling while travelling.

SUMMARY OF THE INVENTION

The first objective of the present invention is to provide a portable container for keeping baby bottle formula cold.

The second object of this invention is to provide an adaptable attachment for existing baby bottles for keeping baby bottle formula cold.

The third object of this invention is to provide a container for keeping baby bottle formula cold that allows the baby to drink the formula while maintaining the formula at a non-spoiling temperature.

The fourth object of this invention is to provide a nontoxic method of keeping baby bottle formula cold.

In a preferred embodiment, an insertion container can be used with traditional type baby bottles. The container can include a longitudinal tube filled with a chilled nontoxic liquid such as frozen ice water. The tube can be inserted into a baby bottle and is supported within the bottle by a base rim which is located in the area between the top of the mouth of the bottle and the bottle cap. The base rim can include peripheral through holes for allowing baby bottle formula such as milk and the like to flow to the nipple portion of the bottle. The base rim further can include central holes for allowing the chilled drinking liquid to flow to the nipple. Optionally, the base rim can include a rubber type plug to seal the fill holes and prevent the chilled liquid in the tube from contacting the formula when the bottle is in actually being used. An alternative arrangement includes combining multiple tubes together end-to-end for using the invention with larger and longer bottles. An second alternative arrangement includes a curved insert for use with bottles that contain a center gripping hole.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation. The components of the figures will first be discussed followed by how the components of the invention function together in a preferred embodiment.

Figure 1:
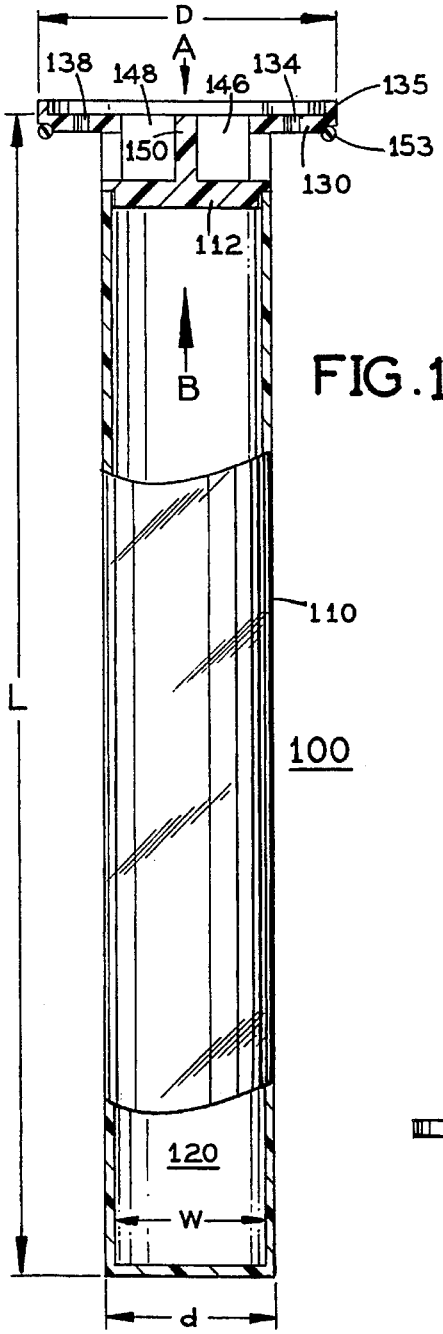
FIG. 1 shows a side cut-away view of the baby bottle insert invention.
Figure 2A:
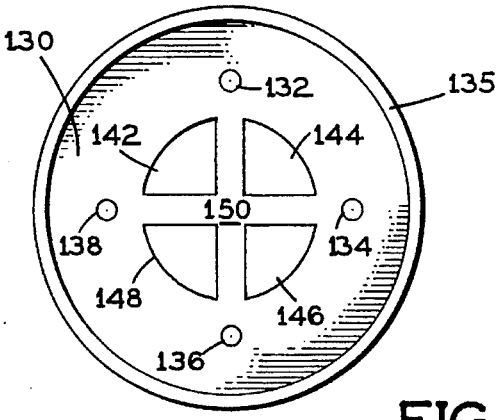
FIG. 2*a* shows a top view of the invention of FIG. 1 along arrow A.
Figure 2B:
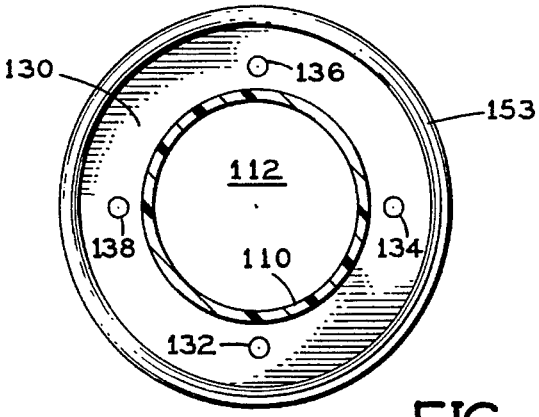
FIG. 2*b* shows a bottom view of the invention of FIG. 1 along arrow B.

FIG. 1 shows a side cut-away view of the baby bottle insert 100. FIG. 2*a* shows a top view of the invention 100 of FIG. 1 along arrow A. FIG. 2*b* shows a bottom view of the invention 100 of FIG. 1 along arrow B. The components of FIGS. 1, 2*a* and 2*b* will now be described. Tube 110 can be formed of clear plastic having a length "L" of approximately 5 and ½ inches long and walls "w" that are approximately ⅝ of an inch thick. The top portion includes a base 130 having a diameter "D" sized to the same diameter as the mouth diameter "X" of the baby bottle 400 shown in FIG. 4 which will be discussed later.

Referring back to FIGS. 1, 2*a* and 2*b*, base 130 includes a rubber type O-Ring 153 along its bottom side and a raised circular rim 135 on the top side of base 130. Base 130 further includes peripheral through holes 132, 134, 136 and 138 having a diameter of approximately ⅞ to ¾ inch width, for allowing bottle formula 500 (shown in FIG. 5) to freely flow through. Referring to FIGS. 1, 2*a* and 2*b*, base 130 can be adhered to the outer edges of cross portion 150 by glue, cement or the like. In this position cross portion 150 forms center holes 142, 144, 146 and 148 for allowing the formula to freely flow from the bottle to the nipple portion shown in FIG. 4. The base 130 and tube 110 can be formed from well known injection molding using plastic and the like.

Figure 3C:
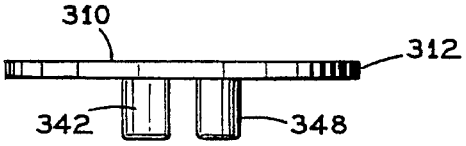
FIG. 3*c* shows a side view of the optional plug of FIG. 3*a*.
Figure 3A:
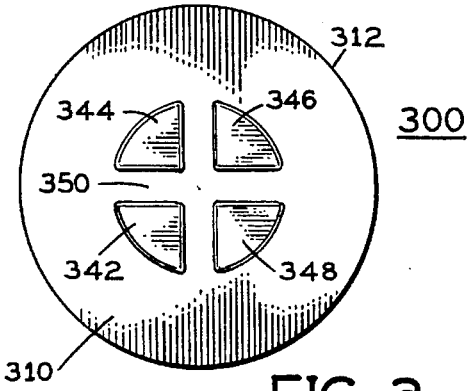
FIG. 3*a* shows a bottom view of an optional plug for use with the invention of FIG. 1.
Figure 3B:
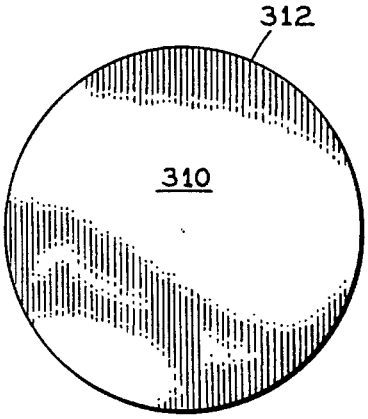
FIG. 3*b* shows a top view of the optional plug of FIG. 3*a*.

FIG. 3*a* shows a bottom view of an optional plug 300 for use with the invention 100 of FIG. 1 with prongs 342, 344, 346 and 348 surrounded by peripheral edge 312. FIG. 3*b* shows a top view 310 of the optional plug 300 of FIG. 3*a*. FIG. 3*c* shows a side view of the optional plug 300 of FIG. 3*a* with prong protrusions 342 and 348. Plug 300 can be formed from materials such as but not limited to rubber, cork and the like. Protrusions 342, 344, 346 and 348 are of such size and shape as cream as water tight seal when inserted into respective fill holes 142, 144, 146 and 148 of the base 130 of FIG. 2*a*. Open area 350 is cross-shaped and sized to fit cross piece 150 shown in FIG. 4.

Figure 4A:
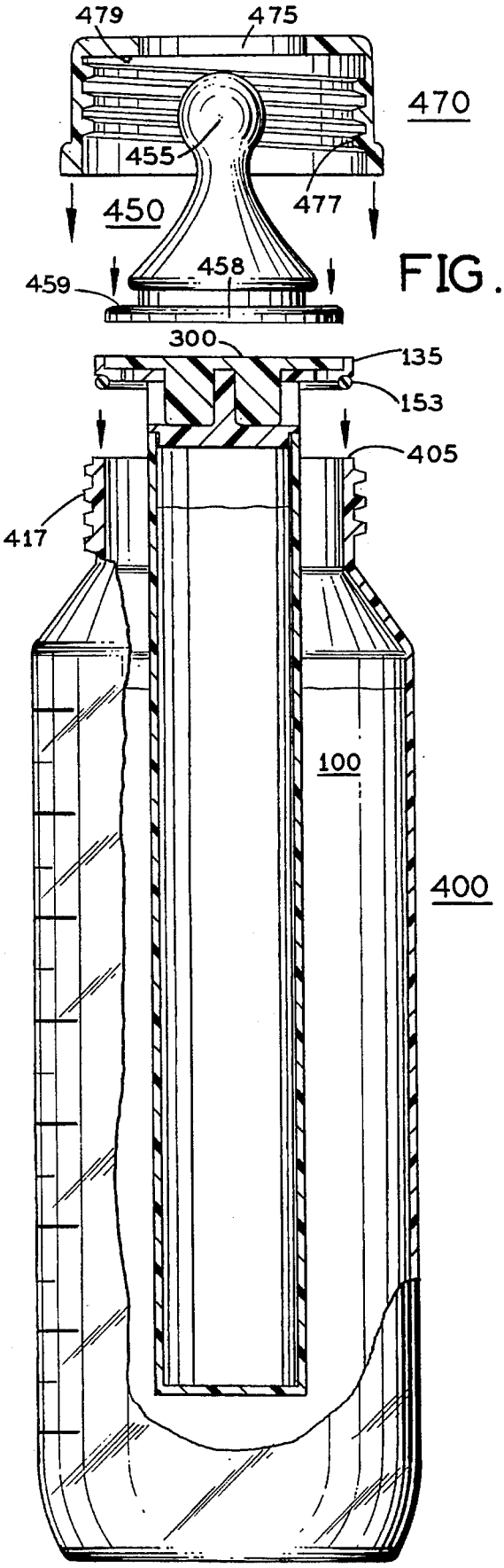
FIG. 4*a* shows an exploded cut-away view of the invention of FIG. 1 with a baby bottle.

The assembly and operation of the components of the invention depicted in FIGS. 1, 2*a*, 2*b*, 3*a*, 3*b* and 3*c* will now be discussed. Referring to FIG. 1, preferably a nontoxic liquid 120 such as water fills tube 110. As shown in FIG. 1, hollow tube 110 can be pre-filled with liquid such as water and then sealed at the top by being adhered to a circular cover lid 112 by glue, epoxy, cement or the like. Next, the invention insert 100 can be placed into a freezer to freeze the liquid 120 into ice in order to allow baby formula such as milk to be maintained at a temperature that avoids spoiling. Optionally, prongs 342, 344, 346, 348 and peripheral edge 312 of plug 300 shown in FIGS. 3*a* to 3*c* can be used to plug up respective holes 142, 144, 146, 148 and holes 132 to 138 of base 130 as shown in FIG. 4*a*. Optional plug 300 can be used in order to prevent formula in the bottle 400 from spilling during nonuse of the bottle.

Referring to FIG. 4*a*, insert 100 is inserted through the mouth portion 410 of the baby bottle until O-Ring 153 is aligned and abuts against the top rim 405 of mouth 410. Next, base edge portions 458 of bottle nipple 450 is aligned and abuts against the top of raised rim 135. Finally, cap 470 is positioned so that the tip portion 455 of nipple 450 passes through the hole 475 of cap 470. Cap 470 is tightened by rotating cap 470 to bottle 400 by respective matching threads 477 and 417. When tightened down, the upper inside wall 479 of cap 470 creates a water proof seal while abutted against portion 459 of nipple 450.

Figure 4B:
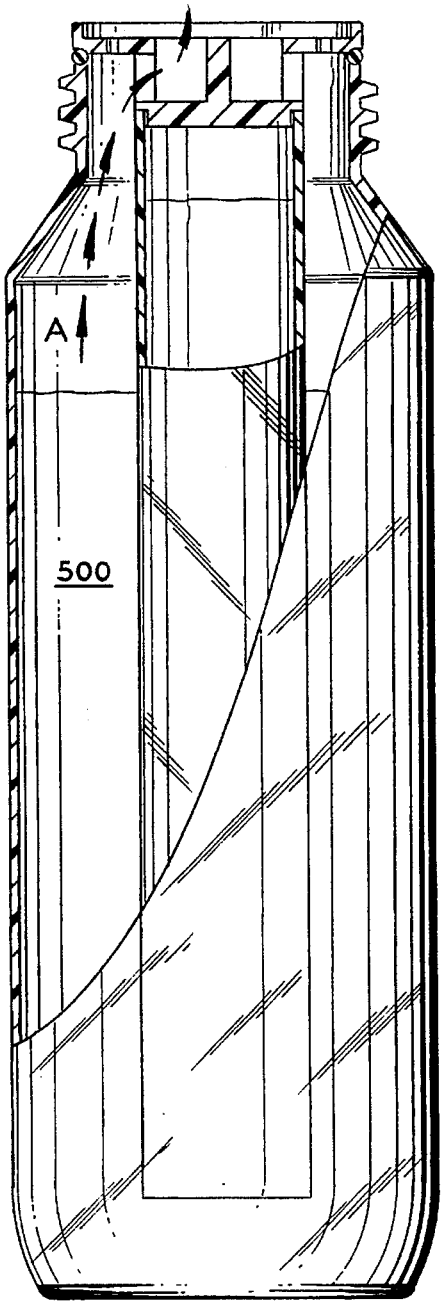
FIG. 4*b* shows a view of FIG. 4*a* without the plug insert.
Figure 5:
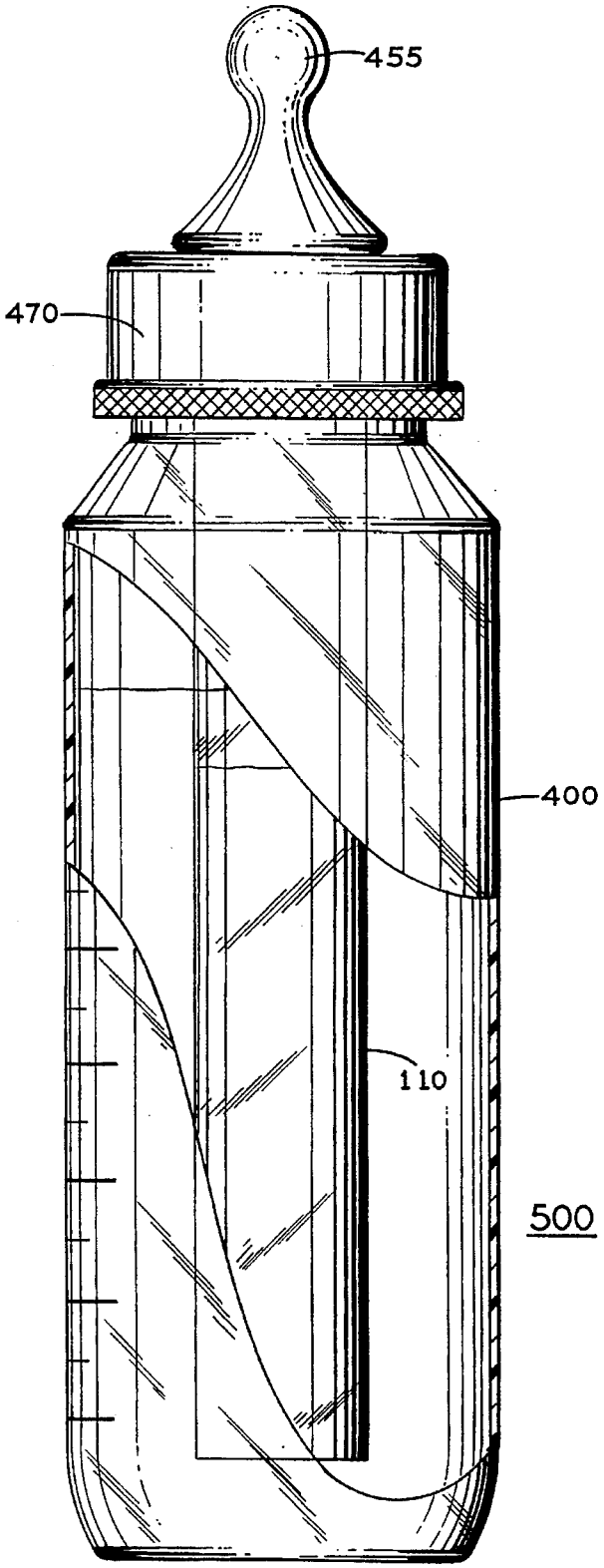
FIG. 5 shows an external side view of the components of FIG. 4 assembled.

FIG. 4*b* shows the view of FIG. 4*a* without insert plug 300. Arrow A illustrates the flow direction of formula 500 toward nipple area 450 (not shown) when plug 300 is not being used. FIG. 5 shows an external side view of the components of FIGS. 4*a* and 4*b* assembled together.

Figure 6:
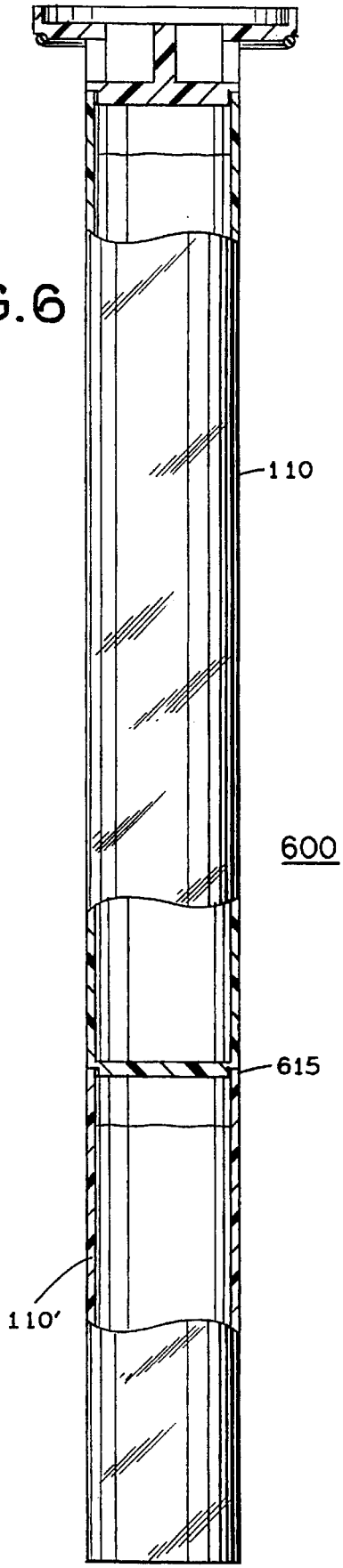
FIG. 6 shows an alternative elongated tube of the invention of FIG. 1 for larger bottles.

FIG. 6 shows an alternative bottle insert 600 which can be used in larger bottles, which combines the invention depicted in FIG. 1 with an additional tube 110'. Here, Tubes 110 and 110' are connected together at 615 by techniques such as but not limited to plastic welding, glue and the like. Insert 600 can be used with different sized bottles in a similar way to that previously described in FIGS. 4*a*, 4*b* and 5.

Figure 7:
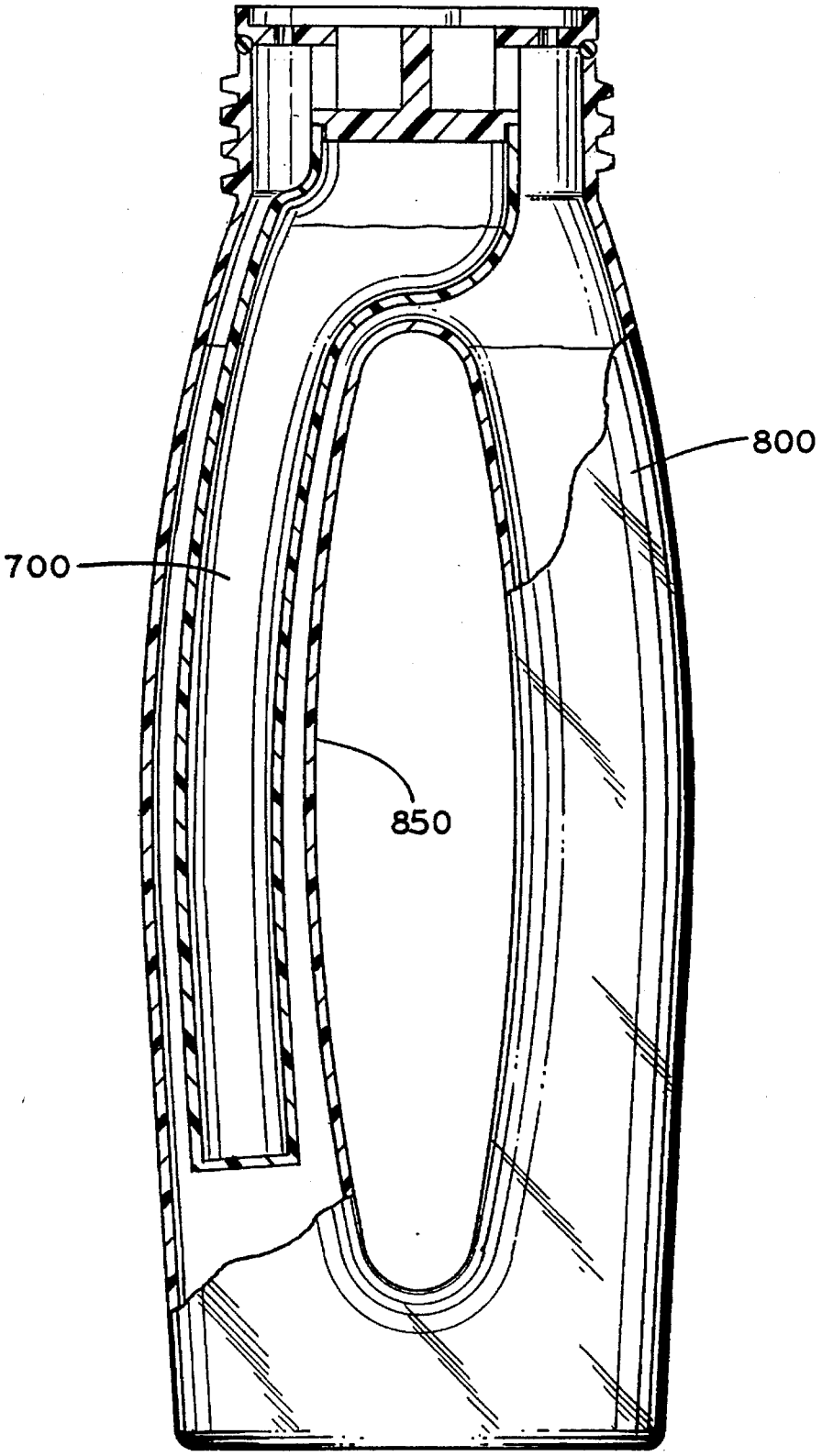
FIG. 7 shows a second alternative curved insert of FIG. 1, for use with bottles that contain center holes for gripping.

FIG. 7 shows an alternative curved insert tube 700 for use with a modified baby bottle 800 that has a center hole 850 that is used for gripping bottle 800.

While the embodiment has been described as being used with a baby bottle, the invention can be use to cool and chill the inserts of other types of bottles such as but not limited to sport bottles, portable liquid containers and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An insert container for keeping formula cold in a baby bottle comprising:

a first longitudinal plastic tube having an upper end and a lower end and being pre-filled and sealed with a chilled liquid;

a baby bottle having a mouth portion for inserting the first longitudinal tube therein;

a support means having a raised rim portion;

a bottle nipple configured to align and abut against the top of the raised rim portion;

a protruding portion attached to a lower side of the support means and having an opening therethrough, the protruding portion being connected to the upper end of the first longitudinal tube, the rim portion of the support means being sealed about the mouth portion of the bottle, wherein the first longitudinal tube is supported within the bottle beneath the rim portion and formula inside the bottle can pass through the opening in the protruding portion to a location exterior to the bottle.

2. The insert container of claim 1, wherein the support means further includes:

an O-Ring for sealing the support means to the mouth portion of the bottle.

3. The insert container of claim 1, further comprising a removable plug for insertion into the opening in the, protruding portion that prevents the formula from flowing external to the bottle when the bottle is not being used.

4. The insert container of claim 1, further comprising:

a second tube pre-filled and sealed with a chilled liquid, the second tube having one end attached to the lower end of the first tube.

5. The insert container of claim 1, wherein the longitudinal tube further includes:

a curved shape:

and the baby bottle further includes:

a hole through the sides for gripping the bottle.

6. The insert container of claim 1, wherein the protruding portion further includes:

a cross shape with openings therethrough.

7. A chilling insert attachment for baby bottles comprising:

a longitudinal tube pre-filled and sealed with a chilled liquid;

a baby bottle for inserting the tube therein, the bottle having a nipple; 1 a support means for supporting the tube to and within a mouth portion of the bottle, the support means including a first opening for allowing formula in the bottle to pass from the bottle through the nipple to a location external to the bottle;

means for sealing the support means to the mouth portion of the bottle;

means for sealing the support means to the nipple; and a removable plug for insertion into the first opening that prevents the formula from spilling out of the bottle when the baby bottle is not being used.

8. The chilling attachment of claim 7, further including forming the tube from: plastic.

9. The chilling attachment of claim 7, further comprising:

a second tube having one end attached to an end of the first tube.

10. The chilling attachment of claim 7, wherein the longitudinal tube further includes:

a curved shape;

and the baby bottle further includes:

a hole through the sides for gripping the bottle.

11. The chilling attachment of claim 7, wherein the support means includes:

a lower protruding portion having the first opening therethrough.

12. The chilling attachment of claim 11, wherein the protruding portion further includes:

a cross shape with openings therethrough.

* * * * *